US011476644B2

(12) United States Patent
Tsuga et al.

(10) Patent No.: US 11,476,644 B2
(45) Date of Patent: Oct. 18, 2022

(54) SPARK PLUG

(71) Applicant: NGK SPARK PLUG CO., LTD., Nagoya (JP)

(72) Inventors: Shunsuke Tsuga, Nagoya (JP); Keiji Ozeki, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/413,239

(22) PCT Filed: Apr. 27, 2020

(86) PCT No.: PCT/JP2020/017969
§ 371 (c)(1),
(2) Date: Jun. 11, 2021

(87) PCT Pub. No.: WO2021/106243
PCT Pub. Date: Jun. 3, 2021

(65) Prior Publication Data

US 2022/0077661 A1 Mar. 10, 2022

(30) Foreign Application Priority Data

Nov. 29, 2019 (JP) ..... JP2019-217483

(51) Int. Cl.
*H01T 13/20* (2006.01)
*H01T 13/06* (2006.01)

(52) U.S. Cl.
CPC ..... *H01T 13/20* (2013.01); *H01T 13/06* (2013.01)

(58) Field of Classification Search
CPC ..... H01T 13/20; H01T 13/06; H01T 13/32; H01T 13/54
See application file for complete search history.

(56) References Cited

U.S. PATENT DOCUMENTS

2007/0069617 A1* 3/2007 Tozzi ..... F02B 19/12 313/140
2009/0309475 A1 12/2009 Tozzi
(Continued)

FOREIGN PATENT DOCUMENTS

CN 103050890 A 4/2013
CN 106025800 A 10/2016
(Continued)

OTHER PUBLICATIONS

International Search Report from corresponding International Patent Application No. PCT/JP20/17969, dated Jul. 21, 2020.
(Continued)

*Primary Examiner* — Kevin Quarterman
(74) *Attorney, Agent, or Firm* — Kusner & Jaffe

(57) ABSTRACT

The spark plug includes a cylindrical insulator, a center electrode provided in the insulator, and a cylindrical metal shell provided around the insulator. A ledge portion of the metal shell has a frontward facing surface facing a front side, a rearward facing surface facing a rear side, and a connection surface connecting the rearward facing surface and the frontward facing surface. The rearward facing surface engages with a step portion of the insulator. The metal shell includes a front cylindrical portion connected to the front side of the ledge portion. The inner circumferential surface of the front cylindrical portion is connected to the frontward facing surface of the ledge portion via a chamfered surface or a rounded surface. A corner at which the connection surface and the frontward facing surface are connected is located on the front side with respect to a front end of the insulator.

3 Claims, 6 Drawing Sheets

(56) References Cited

U.S. PATENT DOCUMENTS

| | | | | |
|---|---|---|---|---|
| 2010/0133978 | A1* | 6/2010 | Ishida | H01T 13/20 313/141 |
| 2016/0254650 | A1 | 9/2016 | Maul et al. | |
| 2016/0285240 | A1 | 9/2016 | Hisada | |

FOREIGN PATENT DOCUMENTS

| | | | |
|---|---|---|---|
| JP | 55-53895 | U1 | 4/1980 |
| JP | 2013-503447 | A | 1/2013 |
| JP | 2016-184571 | A | 10/2016 |
| WO | WO2011/031449 | A2 | 3/2011 |

OTHER PUBLICATIONS

Office Action (with English machine translation) dated Aug. 17, 2021 from corresponding Japanese Patent Appl. No. P2019-217483.
Office Action (with English-language machine translation) dated Nov. 19, 2021 from corresponding Chinese patent Appl. No. 202080008762.X.
Office Action (with English-language machine translation) dated May 9, 2022 from corresponding Chinese patent Appl. No. 202080008762.X.
Written Opinion of the International Searching Authority dated Jul. 21, 2020 from corresponding PCT Appl. No. PCT/JP2020/017969.

* cited by examiner

SPARK PLUG

FIELD OF THE INVENTION

The present invention relates to a spark plug, and in particular, relates to a spark plug that can improve anti-fouling characteristics.

BACKGROUND OF THE INVENTION

There is known a spark plug that includes a cylindrical insulator having an axial hole, a center electrode provided in the axial hole of the insulator, and a cylindrical metal shell provided around the outer circumference of the insulator, wherein a step portion of the insulator is engaged with a ledge portion of the metal shell. In the spark plug attached to an engine, carbon generated by incomplete combustion of an air-fuel mixture or the like is deposited on the insulator and the insulator is fouled. As a result, the insulation resistance is reduced and thus, if a leak current flows at a voltage lower than a required voltage (voltage at which spark discharge occurs), discharge does not occur. In order to prevent occurrence of the leak due to fouling of the insulator, Japanese Patent Application Laid-Open (kokai) No. 2016-184571 ("Patent Document 1") discloses a structure in which, of a gap between a metal shell and an insulator, a center part in the axial-line direction is made largest.

However, in the above structure, since the insulator protrudes from the metal shell, carbon carried by gas entering the gap between the metal shell and the insulator might be deposited on the insulator, thus causing fouling.

SUMMARY OF THE INVENTION

The present invention has been made to solve the above problem, and an object of the present invention is to provide a spark plug that can improve anti-fouling characteristics.

To attain the above object, a spark plug of the present invention includes: a cylindrical insulator in which an axial hole extending along an axial line is formed, the cylindrical insulator having, on an outer circumference thereof, a step portion protruding radially outward; a center electrode provided in the axial hole and having a front end protruding from the axial hole; and a cylindrical metal shell provided around the outer circumference of the insulator, the cylindrical metal shell having, on an inner circumference thereof, a ledge portion protruding radially inward, the ledge portion having a frontward facing surface facing a front side, a rearward facing surface facing a rear side, and a connection surface connecting the rearward facing surface and the frontward facing surface, the rearward facing surface engaging with the step portion. The metal shell has a front cylindrical portion which is connected to the front side of the ledge portion and inside which the end of the center electrode is located, and the front cylindrical portion has an inner circumferential surface connected to the frontward facing surface of the ledge portion. The inner circumferential surface and the frontward facing surface are connected via a chamfered surface or a rounded surface, and a corner at which the connection surface and the frontward facing surface are connected is located on the front side with respect to a front end of the insulator.

In the spark plug according to aspect 1, the front cylindrical portion of the metal shell is connected to the front side of the ledge portion of the metal shell, and the front end of the center electrode is located inside the front cylindrical portion. The inner circumferential surface of the front cylindrical portion and the frontward facing surface of the ledge portion are connected via a chamfered surface or a rounded surface. Therefore, gas flowing rearward along the inner circumferential surface of the front cylindrical portion hits on the frontward facing surface of the ledge portion, so that flow of the gas changes into a direction toward the front side. The corner at which the frontward facing surface and the connection surface of the ledge portion are connected is located on the front side with respect to the front end of the insulator, and therefore the gas flowing from the frontward facing surface toward the front side is less likely to hit on the insulator. Thus, carbon carried by the gas is less likely to be deposited on the insulator, whereby anti-fouling characteristics can be improved.

In the spark plug according to aspect 2, the inner diameter of the expanding portion of the front cylindrical portion increases toward the rear side. Therefore, the flow speed of the gas flowing rearward inside the front cylindrical portion is reduced in the expanding portion. Thus, as compared to the case of not providing the expanding portion, the gas is less likely to enter between the insulator and the metal shell, so that carbon carried by the gas is less likely to be deposited on the insulator. Accordingly, in addition to the effect of aspect 1, anti-fouling characteristics can be further improved.

In the spark plug according to aspect 3, a through hole is formed in the cap portion covering the front cylindrical portion from the front side. An air-fuel mixture flows into the front cylindrical portion through the through hole formed in the cap portion, and by an expansion pressure caused by combustion of the air-fuel mixture ignited there, the gas flow including flame can be jetted into a combustion chamber from the through hole of the cap portion. Accordingly, in addition to the effect of aspect 1 or 2, the air-fuel mixture in the combustion chamber can be combusted by the jet flow of flame.

DETAILED DESCRIPTION OF THE INVENTION

Figure 1:
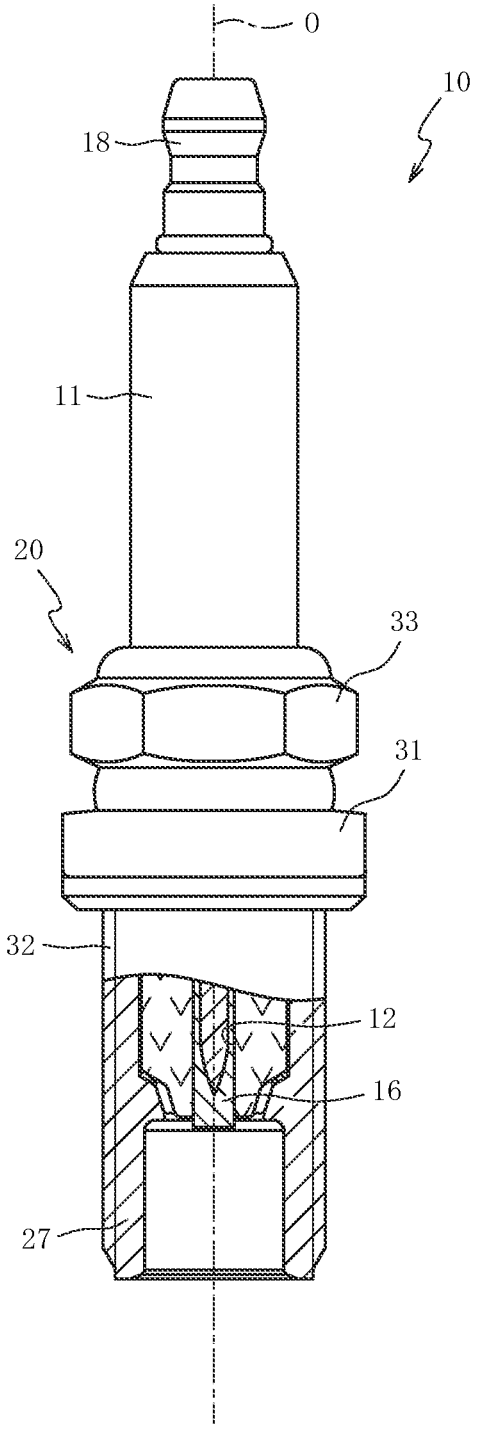
FIG. 1 is a partial sectional view of a spark plug according to the first embodiment.
Figure 2:
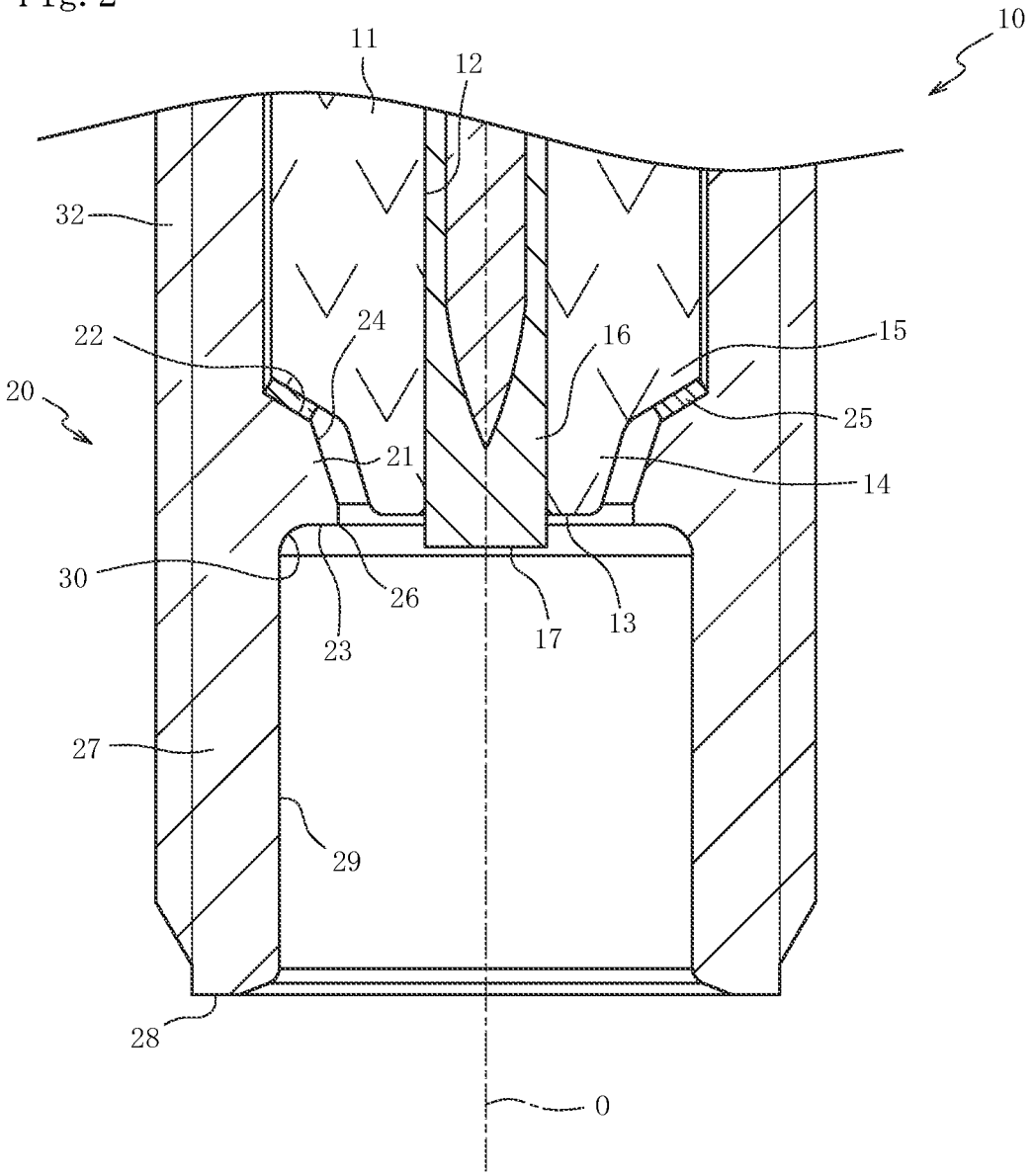
FIG. 2 is a partial sectional view of the spark plug.

Hereinafter, preferred embodiments of the present invention will be described with reference to the accompanying drawings. FIG. 1 is a partial sectional view of a spark plug 10 according to the first embodiment. FIG. 2 is a partial sectional view of the spark plug 10 showing a part around the front end of the spark plug 10 in an enlarged manner. In FIG. 1, the lower side on the drawing sheet is referred to as a front side of the spark plug 10, and the upper side on the drawing sheet is referred to as a rear side of the spark plug 10 (the same applies in FIG. 2 to FIG. 6). In FIG. 1, a cross section including an axial line O of a part on the front side of the spark plug 10 is shown. As shown in FIG. 1, the spark plug 10 includes an insulator 11, a center electrode 16, and a metal shell 20.

As shown in FIG. 2, the insulator 11 is a substantially cylindrical member having an axial hole 12 formed along the axial line O, and is made of ceramic such as alumina which is excellent in mechanical property and in insulation property under high temperature. The insulator 11 has a front end portion 14 including a front end 13 of the insulator 11, and a step portion 15 contiguous to the outer circumference of the front end portion 14 and protruding radially outward. In the present embodiment, the front end portion 14 and the step portion 15 each have a conical outer circumferential surface. A slope angle of the outer circumferential surface of the front end portion 14 with respect to the axial line O is smaller than a slope angle of the outer circumferential surface of the step portion 15 with respect to the axial line O.

The center electrode 16 is provided on the front side of the axial hole 12 of the insulator 11. The center electrode 16 is a bar-shaped member formed by embedding a core material in a conductive metal material (e.g., Ni-based alloy). The core material may be omitted. A front end 17 of the center electrode 16 protrudes from the axial hole 12. The front end 13 of the insulator 11 is located on the rear side with respect to the front end 17 of the center electrode 16.

The center electrode 16 is electrically connected to a metal terminal 18, in the axial hole 12. The metal terminal 18 is a bar-shaped member to which a high-voltage cable (not shown) is connected, and is made of a conductive metal material (e.g., low-carbon steel). The metal terminal 18 is fixed to the rear end of the insulator 11.

The metal shell 20 is a substantially cylindrical member made of a conductive metal material (e.g., low-carbon steel). The metal shell 20 is provided around the outer circumference of the insulator 11. The metal shell 20 has, on the inner circumference thereof, a ledge portion 21 protruding radially inward. The ledge portion 21 is located on the front side with respect to the step portion 15 of the insulator 11. The ledge portion 21 has an annular rearward facing surface 22 facing the rear side, an annular frontward facing surface 23 facing the front side, and an annular connection surface 24 connecting the frontward facing surface 23 and the rearward facing surface 22.

In the present embodiment, the rearward facing surface 22 and the connection surface 24 of the ledge portion 21 are each a conical surface having a diameter that reduces toward the front side. A slope angle of the rearward facing surface 22 with respect to the axial line O is greater than a slope angle of the connection surface 24 with respect to the axial line O. The frontward facing surface 23 of the ledge portion 21 is a surface approximately perpendicular to the axial line O. Therefore, in a cross section including the axial line O, an angle formed by the frontward facing surface 23 and the connection surface 24 of the ledge portion 21 is an acute angle.

An annular packing 25 is interposed between the rearward facing surface 22 of the ledge portion 21 and the step portion 15 of the insulator 11. The packing 25 is an annular member made of a metal material softer than the metal material forming the metal shell 20. The rearward facing surface 22 of the ledge portion 21 engages with the step portion 15 of the insulator 11 via the packing 25.

There is a radial-direction gap between the connection surface 24 of the ledge portion 21 and the insulator 11. The distance between the connection surface 24 of the ledge portion 21 and the insulator 11 is longer than the distance (equal to the thickness of the packing 25) between the rearward facing surface 22 of the ledge portion 21 and the step portion 15 of the insulator 11. A corner 26 at which the connection surface 24 and the frontward facing surface 23 of the ledge portion 21 are connected is located on the front side with respect to the front end 13 of the insulator 11. The corner 26 is formed continuously over the entire circumference of the frontward facing surface 23. The corner 26 is located on the rear side with respect to the front end 17 of the center electrode 16.

The metal shell 20 has a front cylindrical portion 27 connected to the front side of the ledge portion 21. The front cylindrical portion 27 is a substantially cylindrical part inside which the front end 17 of the center electrode 16 is located. In the present embodiment, the inner diameter of the front cylindrical portion 27 is constant over approximately the entire length in the axial-line direction of the front cylindrical portion 27. A front end surface 28 of the front cylindrical portion 27 is an annular surface facing the front side in the axial-line direction. The front end surface 28 is located on the front side with respect to the front end 17 of the center electrode 16. An inner circumferential surface 29 of the front cylindrical portion 27 is connected, over the entire circumference, to the frontward facing surface 23 of the ledge portion 21 via a rounded surface 30. The rounded surface 30 is a circular surface or an elliptic surface connecting the inner circumferential surface 29 of the front cylindrical portion 27 and the frontward facing surface 23 of the ledge portion 21. The radius of curvature of the rounded surface 30 is set to an arbitrary value.

Description will be given returning to FIG. 1. The metal shell 20 has, on the rear side with respect to the ledge portion 21, an annular seat portion 31 protruding radially outward. The metal shell 20 has an external thread 32 on the outer circumferential surface from the front cylindrical portion 27 to the front end of the seat portion 31. By the external thread 32 being screwed into a screw hole of an engine (not shown), the spark plug 10 is attached to the engine. A tool engagement portion 33 of the metal shell 20 provided on the rear side with respect to the seat portion 31 is a part with which a tool such as a wrench is to be engaged when the external thread 32 is screwed into the screw hole of the engine.

When a potential difference arises between the metal terminal 18 and the metal shell 20 of the spark plug 10 attached to the engine (not shown), spark discharge (so-called creeping discharge) mainly along the surface of the front end portion 14 of the insulator 11 (in particular, the front end 13 of the insulator 11) is generated between the center electrode 16 and the corner 26 at which the connection surface 24 and the frontward facing surface 23 of the ledge portion 21 (see FIG. 2) are connected. Of the insulator 11, the outer circumferential surface of the front end portion 14 on the front side with respect to the step portion 15 is exposed to gas in a combustion chamber.

Combustion gas flowing rearward along the inner circumferential surface 29 of the front cylindrical portion 27 is guided by the rounded surface 30 to hit on the frontward facing surface 23 of the ledge portion 21, so that flow of the combustion gas changes into a direction toward the front side. The corner 26 at which the frontward facing surface 23 and the connection surface 24 of the ledge portion 21 are connected is located on the front side with respect to the front end 13 of the insulator 11, and therefore the combustion gas flowing from the frontward facing surface 23 toward the front side is less likely to hit on the front end portion 14 of the insulator 11. As a result, carbon carried by the combustion gas is less likely to be deposited on the front end portion 14 of the insulator 11, whereby anti-fouling characteristics can be improved.

When carbon is deposited on the surface of the front end portion 14 of the insulator 11, spark discharge moves between the front end portion 14 of the insulator 11 and the ledge portion 21 of the metal shell 20 where the insulation resistance has been reduced. As a result, carbon adhered on the surface of the front end portion 14 is burned by the spark discharge. Thus, reduction of the insulation resistance of the insulator 11 can be further suppressed.

Figure 3:
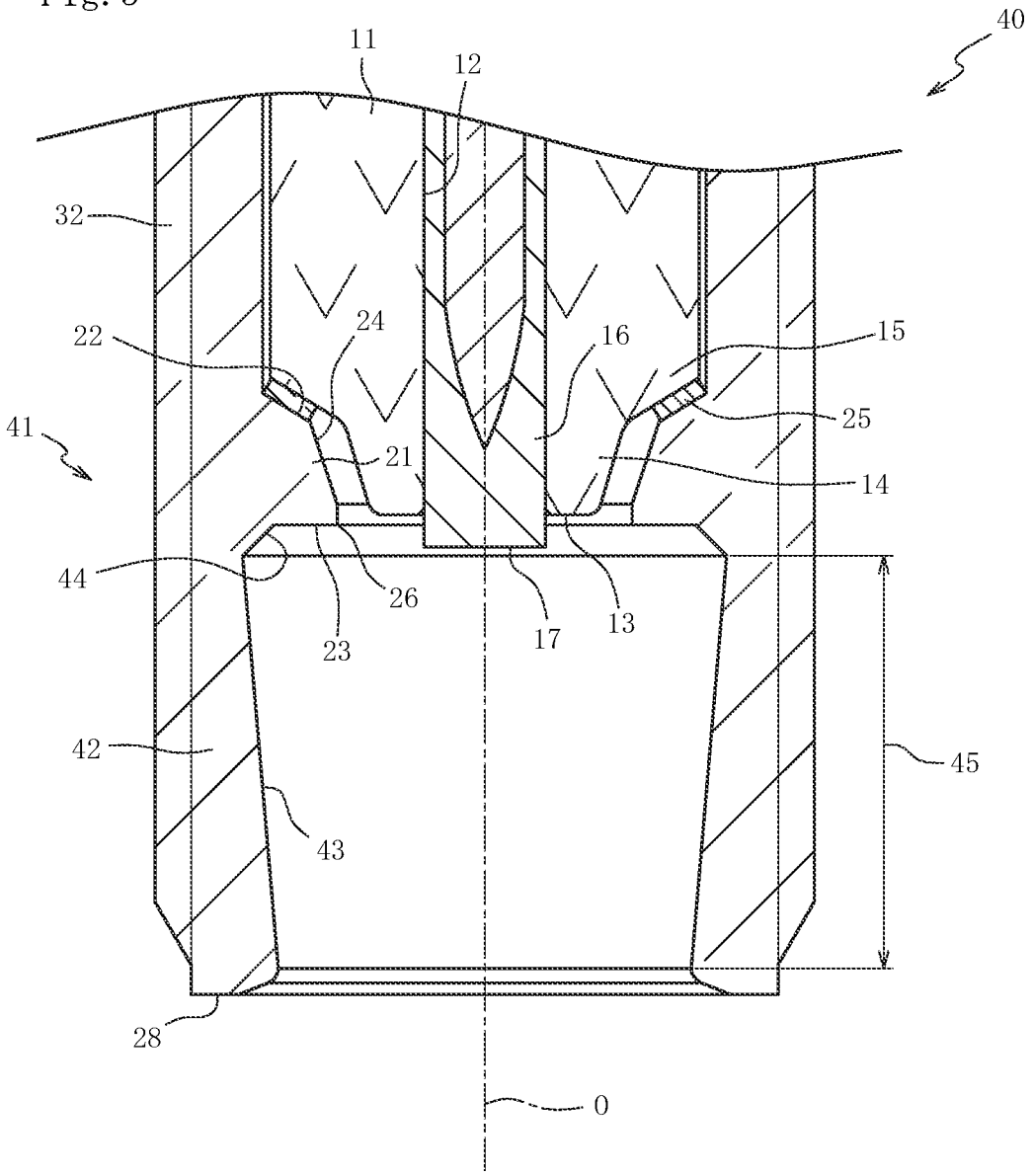
FIG. 3 is a partial sectional view of a spark plug according to the second embodiment.

With reference to FIG. 3, the second embodiment will be described. In the first embodiment, the case where the inner diameter of the front cylindrical portion 27 is constant over approximately the entire length in the axial-line direction of the front cylindrical portion 27, has been described. On the other hand, in the second embodiment, the case where a front cylindrical portion 42 has an expanding portion 45 in which the inner diameter of the front cylindrical portion 42 increases toward the rear side, will be described. The same parts as those in the first embodiment are denoted by the same reference characters and description thereof will not be repeated below. FIG. 3 is a partial sectional view of a spark plug 40 according to the second embodiment. In FIG. 3, the same part as the part shown in FIG. 2 is enlarged (the same applies in FIG. 4 to FIG. 6).

The spark plug 40 includes the insulator 11, the center electrode 16, and a metal shell 41. The metal shell 41 has the substantially cylindrical front cylindrical portion 42 connected to the front side of the ledge portion 21. The front end 17 of the center electrode 16 is located inside the front cylindrical portion 42. The metal shell 41 has the external thread 32 on the outer circumferential surface from the front cylindrical portion 42 to the front end of the seat portion 31 (see FIG. 1).

An inner circumferential surface 43 of the front cylindrical portion 42 is connected, over the entire circumference, to the frontward facing surface 23 of the ledge portion 21 via a chamfered surface 44. The chamfered surface 44 is a corner surface connecting the inner circumferential surface 43 and the frontward facing surface 23. An angle at which the chamfered surface 44 intersects the frontward facing surface 23 is not limited to 45°.

Gas flowing rearward along the inner circumferential surface 43 of the front cylindrical portion 42 is guided by the chamfered surface 44 to hit on the frontward facing surface 23 of the ledge portion 21, so that flow of the gas changes into a direction toward the front side. The corner 26 at which the frontward facing surface 23 and the connection surface 24 of the ledge portion 21 are connected is located on the front side with respect to the front end 13 of the insulator 11, and therefore the gas flowing from the frontward facing surface 23 toward the front side is less likely to hit on the front end portion 14 of the insulator 11. As a result, carbon carried by the gas is less likely to be deposited on the front end portion 14 of the insulator 11, whereby anti-fouling characteristics can be improved.

In the present embodiment, the front cylindrical portion 42 has the expanding portion 45 having an inner diameter that increases toward the rear side. The inner circumferential surface of the expanding portion 45 occupies the entirety of the inner circumferential surface 43 of the front cylindrical portion 42. In the spark plug 40, the flow speed of gas flowing rearward inside the front cylindrical portion 42 is reduced in the expanding portion 45. Thus, as compared to the case of not providing the expanding portion 45, the gas is less likely to enter between the front end portion 14 of the insulator 11 and the ledge portion 21 of the metal shell 20. As a result, carbon carried by the gas is less likely to be deposited on the front end portion 14 of the insulator 11. Thus, anti-fouling characteristics can be further improved.

Figure 4:
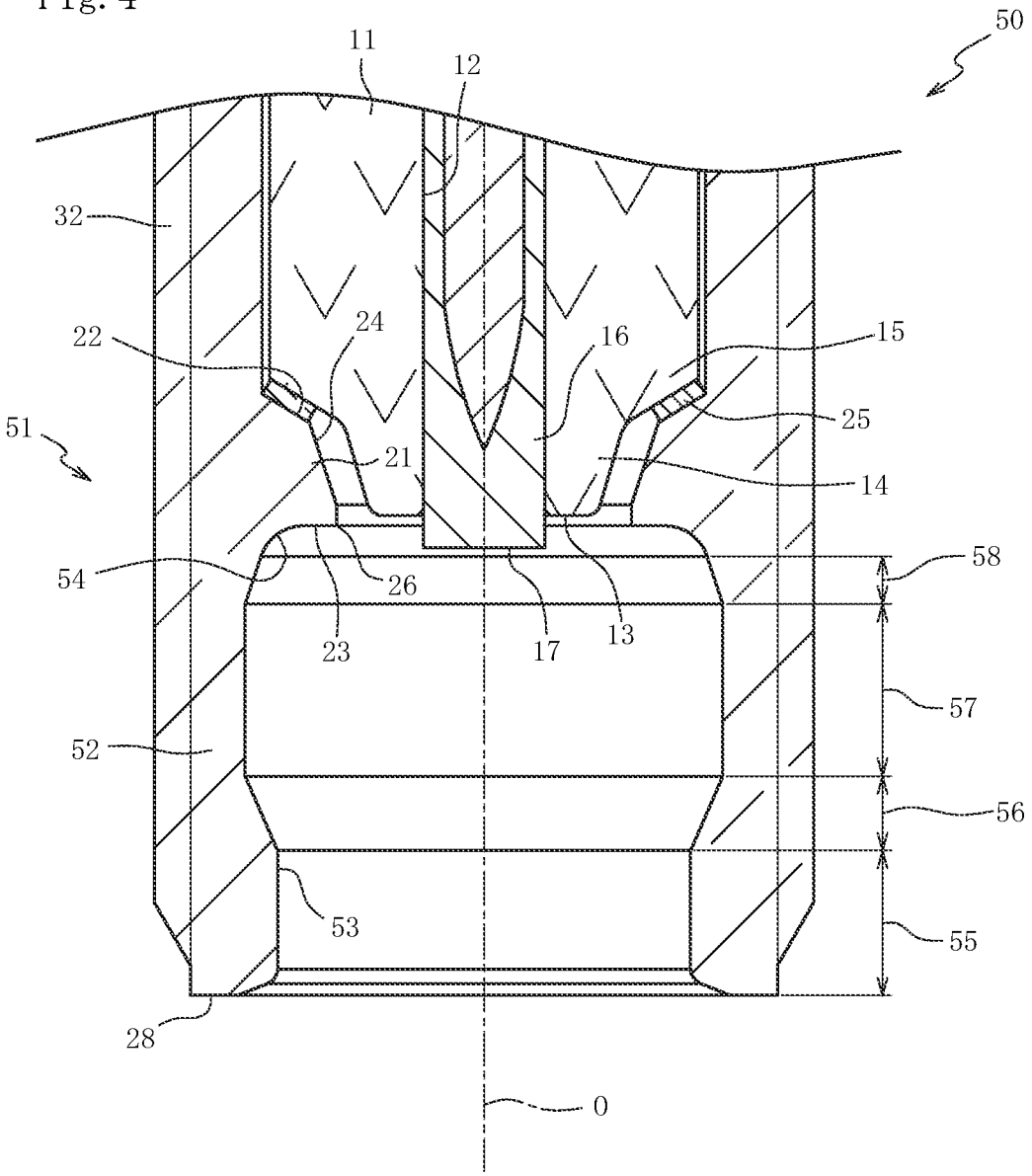
FIG. 4 is a partial sectional view of a spark plug according to the third embodiment.

With reference to FIG. 4, the third embodiment will be described. In the second embodiment, the case where the expanding portion 45 is formed over approximately the entire length of the front cylindrical portion 42, has been described. On the other hand, in the third embodiment, the case where an expanding portion 56 is formed in a part of the entire length in the axial-line direction of a front cylindrical portion 52, will be described. The same parts as those in the first embodiment are denoted by the same reference characters and description thereof will not be repeated below. FIG. 4 is a partial sectional view of a spark plug 50 according to the third embodiment.

The spark plug 50 includes the insulator 11, the center electrode 16, and a metal shell 51. The metal shell 51 has the substantially cylindrical front cylindrical portion 52 connected to the front side of the ledge portion 21. An inner circumferential surface 53 of the front cylindrical portion 52 is connected, over the entire circumference, to the frontward facing surface 23 of the ledge portion 21 via a rounded surface 54. The metal shell 51 has the external thread 32 on the outer circumferential surface from the front cylindrical portion 52 to the front end of the seat portion 31 (see FIG. 1).

In the present embodiment, the front cylindrical portion 52 has a first portion 55, the expanding portion 56, a second portion 57, and a third portion 58 which are connected in this order from the front side to the rear side. The first portion 55 is a part including the front end surface 28 of the front cylindrical portion 52. The inner diameter of the first portion 55 is constant over the entire length in the axial-line direction of the first portion 55. The inner diameter of the expanding portion 56 increases toward the rear side of the expanding portion 56. The length in the axial-line direction of the expanding portion 56 is smaller than the length in the axial-line direction of the first portion 55.

The inner diameter of the second portion 57 is greater than the inner diameter of the first portion 55, and is constant over the entire length in the axial-line direction of the second portion 57. The length in the axial-line direction of the second portion 57 is greater than the length in the axial-line direction of the first portion 55. The inner diameter of the third portion 58 reduces toward the rear side of the third portion 58. The length in the axial-line direction of the third portion 58 is approximately equal to the length in the axial-line direction of the expanding portion 56.

In the spark plug 50, the flow speed of gas flowing rearward inside the front cylindrical portion 52 is reduced in the expanding portion 56, and therefore, as compared to the case of not providing the expanding portion 56, the gas is less likely to enter between the front end portion 14 of the insulator 11 and the ledge portion 21 of the metal shell 20. As a result, carbon carried by the gas is less likely to be deposited on the insulator 11, whereby anti-fouling characteristics can be further improved.

Figure 5:
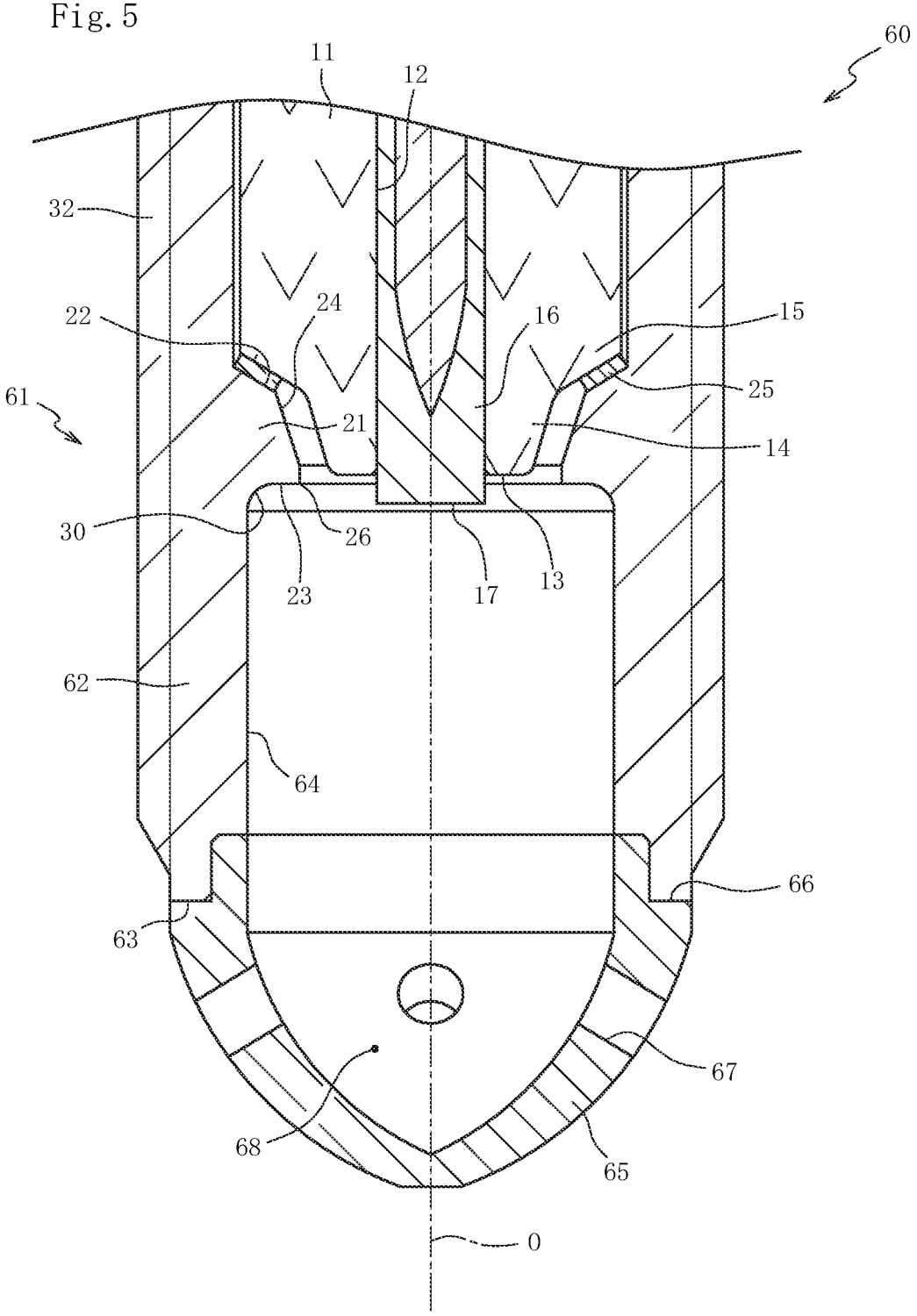
FIG. 5 is a partial sectional view of a spark plug according to the fourth embodiment.

With reference to FIG. 5, the fourth embodiment will be described. In the fourth embodiment, the case of providing a cap portion 65 covering a front cylindrical portion 62 from the front side, will be described. The same parts as those in the first embodiment are denoted by the same reference characters and description thereof will not be repeated below. FIG. 5 is a partial sectional view of a spark plug 60 according to the fourth embodiment.

The spark plug 60 includes the insulator 11, the center electrode 16, a metal shell 61, and the cap portion 65. The metal shell 61 has the substantially cylindrical front cylindrical portion 62 connected to the front side of the ledge portion 21. On a front end surface 63 of the front cylindrical portion 62, a radially outer part protrudes over the entire circumference toward the front side in the axial-line direction. The front end surface 63 of the front cylindrical portion 62 is located on the front side with respect to the front end 17 of the center electrode 16. An inner circumferential surface 64 of the front cylindrical portion 62 is connected, over the entire circumference, to the frontward facing surface 23 of the ledge portion 21 via the rounded surface 30. The metal shell 61 has the external thread 32 formed on the outer circumferential surface from the front cylindrical portion 62 to the front end of the seat portion 31 (see FIG. 1).

The cap portion 65 is a member covering the front cylindrical portion 62 from the front side. In the present embodiment, the cap portion 65 is formed in a hemisphere shape by a metal material containing Fe, etc. as a main component. The main component element of the cap portion 65 is not limited thereto, and as a matter of course, another element may be used as a main component. Examples of other elements include Ni and Cu.

A rear end surface 66 of the cap portion 65 abuts on the front end surface 63 of the front cylindrical portion 62. On the rear end surface 66 of the cap portion 65, a radially inner part protrudes over the entire circumference toward the rear side in the axial-line direction. The cap portion 65 is joined to the front cylindrical portion 62 via a melting portion (not shown) formed by welding over the entire circumference. The cap portion 65 has a through hole 67 penetrating the cap portion 65 in the thickness direction. In the present embodiment, a plurality of through holes 67 are formed in the cap portion 65. A sub chamber 68 inside the front cylindrical portion 62 covered by the cap portion 65, and a combustion chamber (not shown), communicate with each other via the through hole 67.

In the spark plug 60 attached to an engine (not shown), by a valve operation of the engine, an air-fuel mixture flows from the combustion chamber through the through hole 67 into the sub chamber 68 on the inner side of the cap portion 65. The gas (air-fuel mixture) flowing rearward along the inner circumferential surface 64 of the front cylindrical portion 62 is guided by the rounded surface 30 to hit on the frontward facing surface 23 of the ledge portion 21, so that flow of the gas changes into a direction toward the front side. The corner 26 at which the frontward facing surface 23 and the connection surface 24 of the ledge portion 21 are connected is located on the front side with respect to the front end 13 of the insulator 11, and therefore the gas flowing from the frontward facing surface 23 toward the front side is less likely to hit on the front end portion 14 of the insulator 11. As a result, carbon carried by the gas is less likely to be deposited on the front end portion 14 of the insulator 11, whereby anti-fouling characteristics can be improved.

The spark plug 60 generates a flame kernel in the sub chamber 68 by discharge between the ledge portion 21 of the metal shell 61 and the center electrode 16. When the flame kernel grows, the air-fuel mixture in the sub chamber 68 is ignited and thus the air-fuel mixture is combusted. By an expansion pressure caused by the combustion, the spark plug 60 jets the gas flow including the flame, from the through hole 67 into the combustion chamber (not shown). By the jet flow of the flame, the air-fuel mixture in the combustion chamber is combusted. Thus, high-speed combustion can be achieved.

Figure 6:
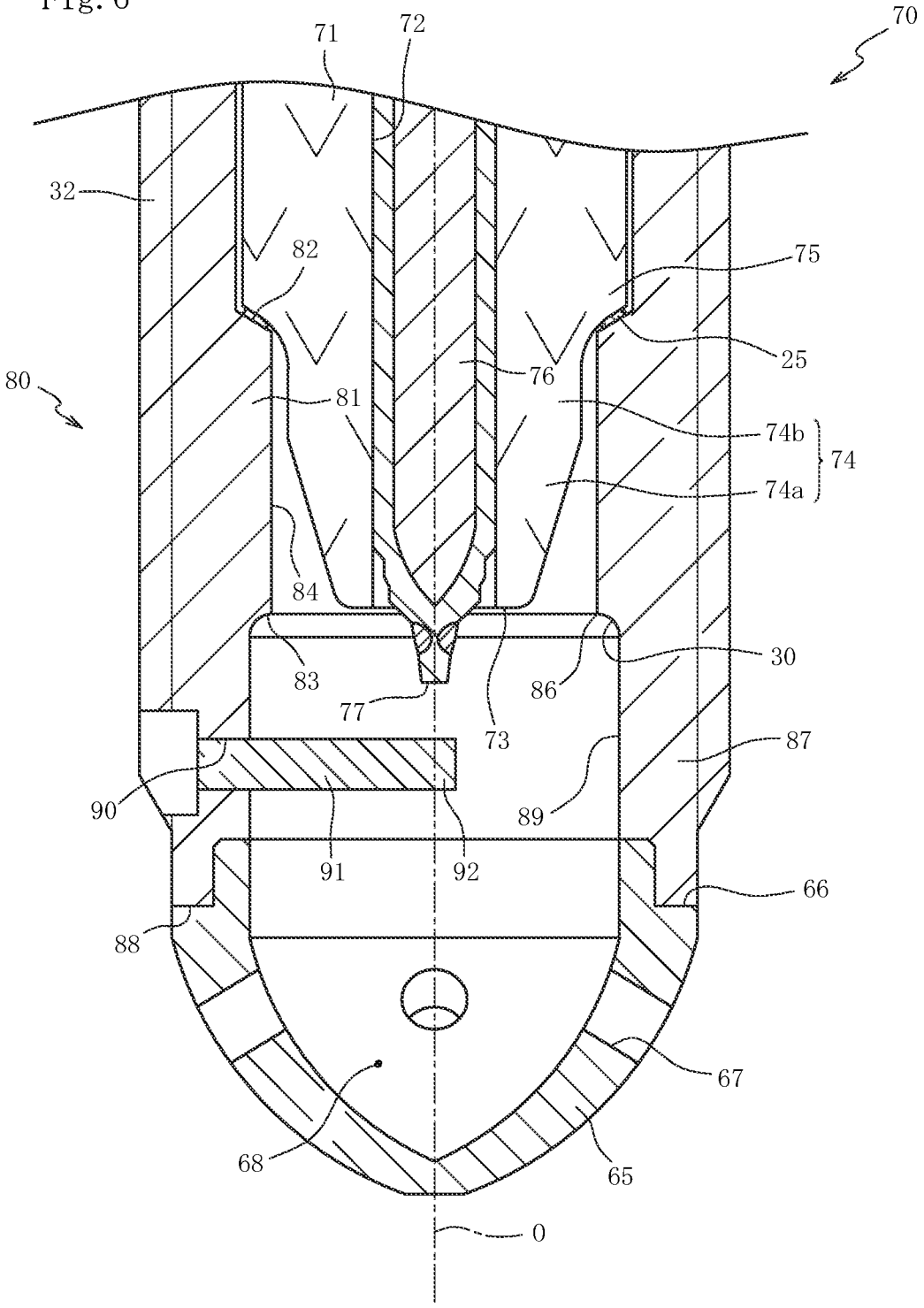
FIG. 6 is a partial sectional view of a spark plug according to the fifth embodiment.

With reference to FIG. 6, the fifth embodiment will be described. In the first to fourth embodiments, the case where spark discharge is generated between the metal shell 20, 41, 51, 61 and the center electrode 16, has been described. On the other hand, in the fifth embodiment, the case where spark discharge is generated between a ground electrode 91 and a center electrode 76, will be described. The same parts as those in the first or fourth embodiment are denoted by the same reference characters and description thereof will not be repeated below. FIG. 6 is a partial sectional view of a spark plug 70 according to the fifth embodiment. The spark plug 70 includes an insulator 71, the center electrode 76, a metal shell 80, and the cap portion 65.

The insulator 71 is a substantially cylindrical ceramic member having an axial hole 72 formed along the axial line O. The insulator 71 has a front end portion 74 including a front end 73 of the insulator 71, and a step portion 75 contiguous to the outer circumference of the front end portion 74 and protruding radially outward. In the present embodiment, the front end portion 74 includes a conical portion **74*a* having an outer diameter that reduces toward the front side, and a cylindrical portion 74*b* contiguous to the rear side of the conical portion 74*a* and having an outer diameter that is approximately constant over the entire length in the axial-line direction. The step portion 75 has a conical outer circumferential surface. A slope angle of the outer circumferential surface of the conical portion 74*a* with respect to the axial line O is smaller than a slope angle of the outer circumferential surface of the step portion 75** with respect to the axial line O.

The center electrode 76 is provided on the front side of the axial hole 72 of the insulator 71. The center electrode 76 is a bar-shaped member formed by embedding a core material in a conductive metal material (e.g., Ni-based alloy). The core material may be omitted. A front end 77 of the center electrode 76 protrudes from the axial hole 72. The thickness of the front end 77 of the center electrode 76 is smaller than the thickness of the base part of the center electrode 76 protruding from the axial hole 72. The front end 73 of the insulator 71 is located on the rear side with respect to the front end 77 of the center electrode 76. The center electrode 76 is electrically connected to the metal terminal 18 (see FIG. 1), in the axial hole 72.

The metal shell 80 is a substantially cylindrical member made of a conductive metal material (e.g., low-carbon steel). The metal shell 80 is provided around the outer circumference of the insulator 71. The metal shell 80 has, on the inner circumference thereof, a ledge portion 81 protruding radially inward. The ledge portion 81 is located on the front side with respect to the step portion 75 of the insulator 71. The ledge portion 81 has an annular rearward facing surface 82 facing the rear side, an annular frontward facing surface 83 facing the front side, and an annular connection surface 84 connecting the frontward facing surface 83 and the rearward facing surface 82.

In the present embodiment, the rearward facing surface 82 of the ledge portion 81 is a conical surface having a diameter that reduces toward the front side. The connection surface 84 is a cylindrical surface having a diameter that is approximately constant over the entire length. The frontward facing surface 83 of the ledge portion 81 is a surface approximately perpendicular to the axial line O. The annular packing 25 is interposed between the rearward facing surface 82 of the ledge portion 81 and the step portion 75 of the insulator 71. The rearward facing surface 82 of the ledge portion 81 engages with the step portion 75 of the insulator 71 via the packing 25.

Between the connection surface 84 of the ledge portion 81 and the conical portion 74*a* of the insulator 71, a gap is formed so as to gradually expand toward the front side. A corner 86 at which the connection surface 84 and the frontward facing surface 83 of the ledge portion 81 are connected is located on the front side with respect to the front end 73 of the insulator 71. The corner 86 is located on the rear side with respect to the front end 77 of the center electrode 76.

The metal shell 80 has a front cylindrical portion 87 connected to the front side of the ledge portion 81. The front cylindrical portion 87 is a substantially cylindrical part inside which the front end 77 of the center electrode 76 is located. In the present embodiment, the inner diameter of the front cylindrical portion 87 is constant over the entire length in the axial-line direction of the front cylindrical portion 87. The front end surface 88 of the front cylindrical portion 87 is located on the front side with respect to the front end 77 of the center electrode 76. The rear end surface 66 of the cap portion 65 abuts on the front end surface 88 of the front cylindrical portion 87.

The cap portion 65 is joined to the front cylindrical portion 87 via a melting portion (not shown) formed by welding over the entire circumference. An inner circumferential surface 89 of the front cylindrical portion 87 is a cylindrical surface. The inner circumferential surface 89 is connected, over the entire circumference, to the frontward facing surface 83 of the ledge portion 81 via the rounded surface 30. The metal shell 80 has the external thread 32 on the outer circumferential surface from the front cylindrical portion 87 to the front end of the seat portion 31 (see FIG. 1). In the present embodiment, a hole 90 penetrating the front cylindrical portion 87 in the thickness direction is formed at the position of the external thread 32 in the front cylindrical portion 87.

The ground electrode 91 is a bar-shaped member, and a front end portion 92 of the ground electrode 91 is opposed to the center electrode 76. The ground electrode 91 is joined to the front cylindrical portion 87 by welding in a state in which the ground electrode 91 is inserted into the hole 90 of the front cylindrical portion 87. The ground electrode 91 is made of a metal material containing Pt, etc. as a main component. The main component element of the ground electrode 91 is not limited thereto, and as a matter of course, another element may be used as a main component. Examples of other components include Ni and Ir. The distance between the front end portion 92 of the ground electrode 91 and the center electrode 76 is smaller than the distance between the corner 86 of the ledge portion 81 of the metal shell 80 and the center electrode 76.

In the spark plug 70 attached to an engine (not shown), by a valve operation of the engine, an air-fuel mixture flows from the combustion chamber through the through hole 67 into the sub chamber 68 on the inner side of the cap portion 65. The gas (air-fuel mixture) flowing rearward along the inner circumferential surface 89 of the front cylindrical portion 87 is guided by the rounded surface 30 to hit on the frontward facing surface 83 of the ledge portion 81, so that flow of the gas changes into a direction toward the front side. The corner 86 at which the frontward facing surface 83 and the connection surface 84 of the ledge portion 81 are connected is located on the front side with respect to the front end 73 of the insulator 71, and therefore the gas flowing from the frontward facing surface 83 toward the front side is less likely to hit on the front end portion 74 of the insulator 71. As a result, carbon carried by the gas is less likely to be deposited on the front end portion 74 of the insulator 71, whereby anti-fouling characteristics can be improved.

The spark plug 70 generates a flame kernel in the sub chamber 68 by discharge (so-called space discharge) between the ground electrode 91 connected to the metal shell 80 and the center electrode 76. When the flame kernel grows, the air-fuel mixture in the sub chamber 68 is ignited and thus the air-fuel mixture is combusted. By an expansion pressure caused by the combustion, the spark plug 70 jets the gas flow including the flame, from the through hole 67 into the combustion chamber (not shown). By the jet flow of the flame, the air-fuel mixture in the combustion chamber is combusted, whereby high-speed combustion can be achieved.

Since the flame kernel is generated by discharge between the front end portion 92 of the ground electrode 91 and the front end 77 of the center electrode 76, energy of the flame kernel is less likely to be taken by the metal shell 80 or the ground electrode 91. Since flame quenching can be less likely to occur, ignitability can be improved. In addition, if a material excellent in spark wear resistance is used for the ground electrode 91, durability can be improved.

While the present invention has been described above with reference to the embodiments, the present invention is not limited to the above embodiments at all. It can be easily understood that various modifications can be devised without departing from the gist of the present invention. For example, the shapes of the front cylindrical portion 27, 42, 52, 62, 87, the ledge portion 21, 81, and the cap portion 65 are merely examples. These shapes are set to arbitrary shapes as appropriate.

In the above embodiments, the case where the front cylindrical portion 27, 42, 52, 62, 87 is formed integrally with the metal shell 20, 41, 51, 61, 80, has been described. However, the present invention is not necessarily limited thereto. As a matter of course, the metal shell 20, 41, 51, 61, 80 may be formed by a plurality of members. For example, a cylindrical member corresponding to the front cylindrical portion 27, 42, 52, 62, 87 separated at the position of the frontward facing surface 23, 83 of the ledge portion 21, 81 is prepared, and this member is joined to the front side of the ledge portion 21, 81 by welding, screw tightening, or the like, thereby manufacturing the metal shell 20, 41, 51, 61, 80.

In the first embodiment, the case where the inner circumferential surface 29 of the front cylindrical portion 27 and the frontward facing surface 23 of the ledge portion 21 are connected via the rounded surface 30, has been described. However, the present invention is not necessarily limited thereto. As a matter of course, the inner circumferential surface 29 of the front cylindrical portion 27 and the frontward facing surface 23 of the ledge portion 21 may be connected via a chamfered surface. The chamfered surface is a corner surface connecting the inner circumferential surface 29 and the frontward facing surface 23. An angle at which the chamfered surface intersects the frontward facing surface 23 is not limited to 45°. Similarly, also in the third to fifth embodiments, as a matter of course, the inner circumferential surface 53, 64, 89 of the front cylindrical portion 52, 62, 87 and the frontward facing surface 23, 83 of the ledge portion 21, 81 may be connected via a chamfered surface.

In the second embodiment, the case where the inner circumferential surface 43 of the front cylindrical portion 42 and the frontward facing surface 23 of the ledge portion 21 are connected via the chamfered surface 44, has been described. However, the present invention is not necessarily limited thereto. As a matter of course, the inner circumferential surface 43 of the front cylindrical portion 42 and the frontward facing surface 23 of the ledge portion 21 may be connected via a rounded surface. The rounded surface is a circular surface or an elliptic surface connecting the inner circumferential surface 43 and the frontward facing surface 23. The value of the radius of curvature of the rounded surface is set as appropriate.

In the above embodiments, the case where the frontward facing surface 23, 83 of the ledge portion 21, 81 is a flat surface approximately perpendicular to the axial line O, has been described. However, the present invention is not necessarily limited thereto. For example, as a matter of course, the frontward facing surface 23, 83 of the ledge portion 21, 81 may be a conical surface or a spherical zone oblique to the axial line O. In the case where the frontward facing surface 23, 83 is a conical surface or a spherical zone, in view of ease of working, it is preferable that the frontward facing surface 23, 83 is sloped toward the rear side as approaching the radially inner side.

In the third embodiment, the case where the expanding portion 56 is provided between the first portion 55 and the second portion 57, has been described. However, the present invention is not necessarily limited thereto. For example, as a matter of course, the expanding portion 56 may be connected to the front end surface 28 of the front cylindrical portion 51 without providing the first portion 55. Similarly, as a matter of course, the expanding portion 56 may be connected to the third portion 58 without providing the second portion 57, or the second portion 57 may be connected to the frontward facing surface 23 without providing the third portion 58. In addition, as a matter of course, the expanding portion 56 may be connected to the frontward facing surface 23 without providing the second portion 57 and the third portion 58. Also in these cases, the flow speed of gas flowing rearward inside the front cylindrical portion 52 can be reduced by the expanding portion 56. Thus, the gas is less likely to enter between the front end portion 14 of the insulator 11 and the ledge portion 21 of the metal shell 20, so that carbon carried by the gas is less likely to be deposited on the insulator 11.

In the fourth and fifth embodiments, the case where the cap portion 65 is welded to the front cylindrical portion 62, 87 of the metal shell 61, 80, has been described. However, the present invention is not necessarily limited thereto. As a matter of course, instead of welding the cap portion 65, a cylindrical member having a cap portion at a front end thereof may be prepared and this cylindrical member may be connected to the metal shell 61, 80, to form the sub chamber 68. For example, the cylindrical member is a cylindrical member of which the front end is closed, and has, on the inner circumferential surface thereof, an internal thread to be screwed to the external thread 32 of the metal shell 61, 80. The cylindrical member has, on the outer circumferential surface thereof, an external thread to be screwed to a screw hole of an engine (not shown). By screwing the internal thread of the cylindrical member to the external thread 32 of the metal shell 61, 80, the cap portion is provided on the front side of the metal shell 61, 80. In this cap portion, the through hole 67 is provided.

Means for connecting the cylindrical member to the metal shell 61, 80 and providing the cap portion on the front side of the metal shell 61, 80 is not limited to the means in which the internal thread on the inner circumferential surface of the cylindrical member is screwed to the external thread 32 of the metal shell 61, 80. As a matter of course, the cylindrical member provided with the cap portion may be connected to the metal shell by another means. As an example of another means, the cylindrical member and the metal shell may be joined by welding or the like. The cylindrical member may be made of a metal material such as a nickel-based alloy or stainless steel, or ceramic such as silicon nitride, for example.

In the fifth embodiment, the case where the ground electrode 91 is joined to the front cylindrical portion 87 covered by the cap portion 65, has been described. However, the present invention is not necessarily limited thereto. For example, as a matter of course, the ground electrode 91 may be joined to the cap portion 65.

In the first to fourth embodiments, the case where a spark gap is formed between the ledge portion 21 of the metal shell 20, 41, 51, 61 and the center electrode 16, has been described. However, the present invention is not necessarily limited thereto. For example, as a matter of course, one or a plurality of ground electrodes may be connected to the front cylindrical portion 27, 42, 52, 62 of the metal shell 20, 41, 51, 61, whereby a spark gap may be formed between the ground electrode and the center electrode 16. In this case, the distance between the ground electrode and the front end portion 14 of the insulator 11, and the distance between the ground electrode and the center electrode 16, are set as appropriate. Through setting of these distances, it is possible to set ease of occurrence of discharge between the front end portion 14 of the insulator 11 and the ledge portion 21, discharge between the front end portion 14 and the ground electrode, and discharge between the ground electrode and the center electrode 16. For example, the distances may be set such that, in a normal case, ignition is performed by spark discharge between the ground electrode and the center electrode 16, and in a fouled condition, carbon adhered on the surface of the front end portion 14 is burned by spark discharge, whereby reduction in insulation property can be further suppressed.

DESCRIPTION OF REFERENCE NUMERALS

10, 40, 50, 60, 70: spark plug
11, 71: insulator
12, 72: axial hole
13, 73: front end of insulator
15, 75: step portion
16, 76: center electrode
17, 77: front end of center electrode
20, 41, 51, 61, 80: metal shell
21, 81: ledge portion
22, 82: rearward facing surface
23, 83: frontward facing surface
24, 84: connection surface
26, 86: corner
27, 42, 52, 62, 87: front cylindrical portion
29, 43, 53, 64, 89: inner circumferential surface
30, 54: rounded surface
44: chamfered surface
45, 56: expanding portion
65: cap portion
67: through hole
O: axial line

The invention claimed is:

1. A spark plug comprising:

a cylindrical insulator in which an axial hole extending along an axial line is formed, the cylindrical insulator having, on an outer circumference thereof, a step portion protruding radially outward;

a center electrode provided in the axial hole and having a front end protruding from the axial hole; and a cylindrical metal shell provided around the outer circumference of the insulator, the cylindrical metal shell having, on an inner circumference thereof, a ledge portion protruding radially inward, the ledge portion having a frontward facing surface facing a front side, a rearward facing surface facing a rear side, and a connection surface connecting the rearward facing surface and the frontward facing surface, the rearward facing surface engaging with the step portion, wherein the metal shell has a front cylindrical portion which is connected to the front side of the ledge portion and inside which the end of the center electrode is located, the front cylindrical portion has an inner circumferential surface connected to the frontward facing surface of the ledge portion, the inner circumferential surface and the frontward facing surface are connected via a chamfered surface or a rounded surface, a corner at which the connection surface and the frontward facing surface are connected is located on the front side with respect to a front end of the insulator, and in a cross section including the axial line, an angle formed by the frontward facing surface and the connection surface is an acute angle.

2. The spark plug according to claim 1, wherein the front cylindrical portion has an expanding portion having an inner diameter that increases toward the rear side.

3. The spark plug according to claim 1, further comprising a cap portion which covers the front cylindrical portion from the front side and in which a through hole is formed.

* * * * *